US007921494B2

(12) United States Patent
Weinmann et al.

(10) Patent No.: US 7,921,494 B2
(45) Date of Patent: Apr. 12, 2011

(54) INTERNAL UNIT, SUSPENDED SUCH THAT IT CAN VIBRATE, OF A LAUNDRY TREATMENT MACHINE, METHOD FOR CONTROLLING A LAUNDRY TREATMENT MACHINE, AND USE OF AN ELECTRONIC SENSOR IN AN INTERNAL UNIT

(75) Inventors: Martin Weinmann, Bad Waldsee (DE); Roman-Hartmut Wauer, Kisslegg (DE); Alexander Müller, Bad Waldsee-Reute (DE)

(73) Assignee: DIEHL AKO Stiftung & Co. KG, Wangen (DE)

( * ) Notice: Subject to any disclaimer, the term of this patent is extended or adjusted under 35 U.S.C. 154(b) by 1005 days.

(21) Appl. No.: 11/359,918

(22) Filed: Feb. 21, 2006

(65) Prior Publication Data

US 2006/0185097 A1 Aug. 24, 2006

(30) Foreign Application Priority Data

Feb. 18, 2005 (DE) ..... 10 2005 007 413
Aug. 6, 2005 (DE) ..... 10 2005 037 144

(51) Int. Cl.
*D06F 33/02* (2006.01)

(52) U.S. Cl. ..... 8/159; 8/158; 68/12.02; 68/12.06; 68/23.1; 68/24

(58) Field of Classification Search ..... 68/12.02, 68/12.06, 23.1, 24; 8/158, 159
See application file for complete search history.

(56) References Cited

U.S. PATENT DOCUMENTS

| | | | | |
|---|---|---|---|---|
| 5,098,224 | A | 3/1992 | Netzel et al. | |
| 5,207,764 | A * | 5/1993 | Akabane et al. | 68/20 |
| 5,768,730 | A * | 6/1998 | Matsumoto et al. | 8/159 |
| 5,907,880 | A | 6/1999 | Durazzani et al. | |
| 6,122,843 | A * | 9/2000 | Noguchi et al. | 34/596 |
| 6,292,966 | B1 * | 9/2001 | Lim et al. | 8/158 |
| 6,742,208 | B2 * | 6/2004 | Broker | 8/158 |
| 6,826,932 | B2 * | 12/2004 | Sonoda et al. | 68/12.06 |
| 6,854,299 | B2 * | 2/2005 | Weinmann et al. | 68/12.02 |
| 6,856,841 | B2 * | 2/2005 | Peterson | 700/19 |
| 2003/0015039 | A1 | 1/2003 | Baek | |
| 2004/0148973 | A1 * | 8/2004 | No et al. | 68/12.06 |

(Continued)

FOREIGN PATENT DOCUMENTS

DE 37 41 791 C3 1/1998

(Continued)

*Primary Examiner* — Joseph L Perrin
*Assistant Examiner* — Benjamin Osterhout
(74) *Attorney, Agent, or Firm* — Laurence A. Greenberg; Werner H. Stemer; Ralph E. Locher

(57) ABSTRACT

An internal unit of a washing machine or spin-dryer normally includes a washing container, which has a laundry drum mounted in the container such that it can rotate, and an electric motor for driving the laundry drum via a reduction gear, a transmission, or direct drive. The internal unit is suspended in a machine housing such that it can vibrate and constitutes an overall system which can vibrate in a damped manner and which is subject to unbalance-dependent resonance phenomena in specific regions of the rotational speed of the laundry drum. The causes of these resonance phenomena are vibratory movements due to momentary unbalances in the load in the laundry drum. To reduce these unbalance-dependent resonance phenomena, the internal unit is provided with a vibration sensor which is rigidly or substantially rigidly coupled to the internal unit

21 Claims, 1 Drawing Sheet

U.S. PATENT DOCUMENTS

| | | | | |
|---|---|---|---|---|
| 2004/0154351 | A1* | 8/2004 | Kim et al. | 68/12.06 |
| 2004/0172985 | A1* | 9/2004 | Mamiya et al. | 68/12.05 |
| 2004/0182116 | A1* | 9/2004 | Czyzewski et al. | 68/12.02 |
| 2005/0016226 | A1* | 1/2005 | Okazaki et al. | 68/12.04 |
| 2005/0066450 | A1 | 3/2005 | Weinmann | |
| 2006/0010936 | A1 | 1/2006 | Weinmann et al. | |

FOREIGN PATENT DOCUMENTS

| | | | |
|---|---|---|---|
| DE | 100 07 839 | A1 | 3/2001 |
| DE | 103 45 591 | B3 | 7/2005 |
| DE | 10 2004 053 216 | B3 | 2/2006 |
| EP | 0 349 789 | B1 | 10/1992 |
| EP | 0 878 574 | A1 | 11/1998 |

* cited by examiner

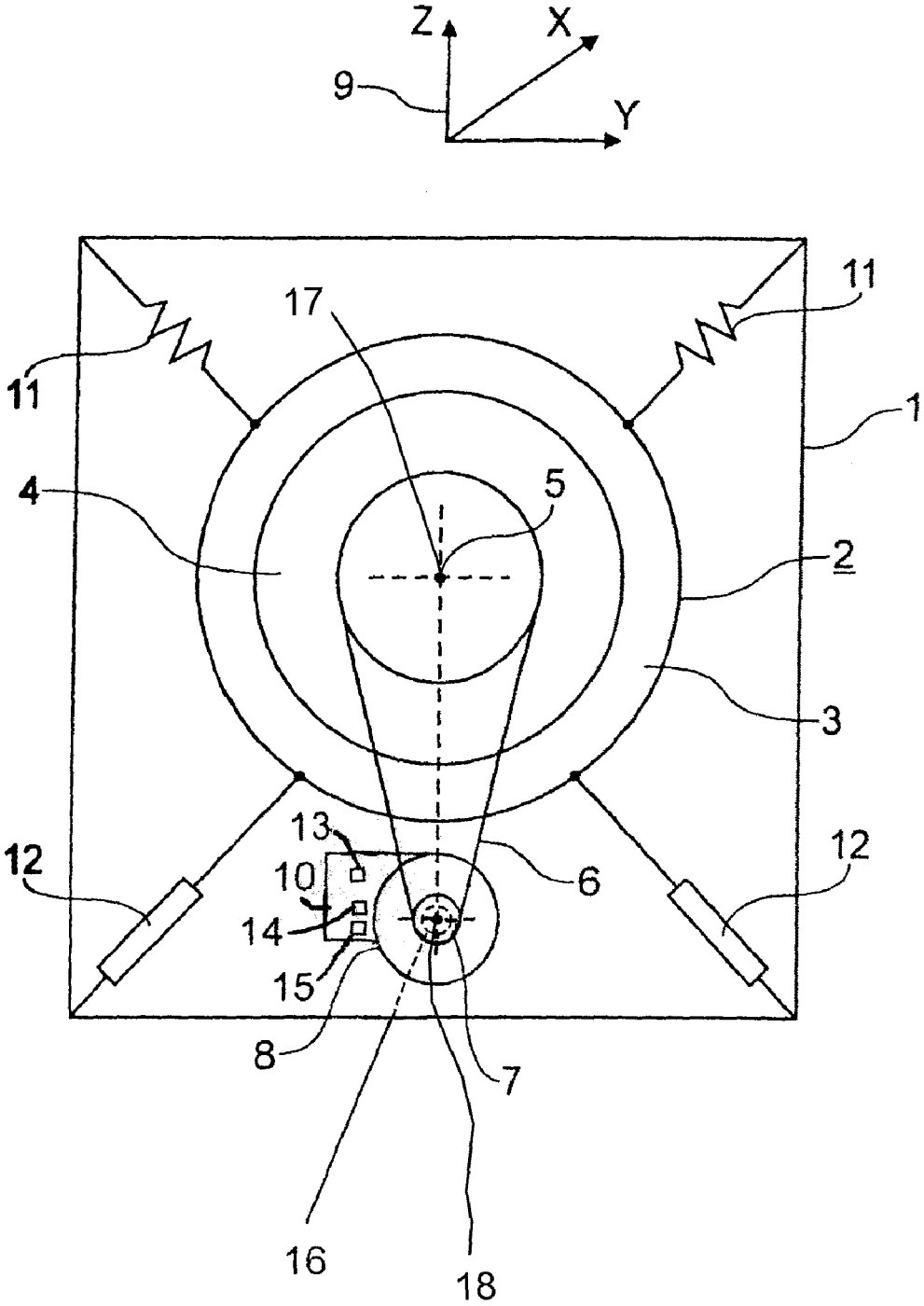
Z
X
Y
9
11
11
17
1
4
5
2
3
13
10
14
15
6
12
12
8
7
16
18

INTERNAL UNIT, SUSPENDED SUCH THAT IT CAN VIBRATE, OF A LAUNDRY TREATMENT MACHINE, METHOD FOR CONTROLLING A LAUNDRY TREATMENT MACHINE, AND USE OF AN ELECTRONIC SENSOR IN AN INTERNAL UNIT

BACKGROUND OF THE INVENTION

Field of the Invention

The invention relates to an internal unit, which is suspended such that it can vibrate, of a laundry treatment machine. The internal unit has a laundry drum and a drive for the laundry drum, which drive is in the form of an electric motor. The invention also relates to a method for controlling a laundry treatment machine, with the vibratory movements of an internal unit of a laundry treatment machine being measured, and to the use of an electronic sensor in the internal unit.

The internal unit of a washing machine or spin-dryer normally includes a washing container, which has a laundry drum which is mounted in the container such that it can rotate, and a drive unit in the form of an electric motor which usually drives the laundry drum via a reduction gear or a transmission. The internal unit is suspended in a machine housing such that it can vibrate and constitutes an overall system which can vibrate in a damped manner and is subject to unbalance-dependent resonance phenomena in specific ranges of the rotational speed of the laundry drum, the speed being lower than the rotational speed of the motor in a case of a transmission. The causes of the resonance phenomena are vibratory movements due to momentary unbalances in the load in the laundry drum.

Vibratory movements such as these, which are the result of unbalances, can be countered in the program sequence of a washing machine or spin-dryer by a specific laundry distribution phase. For this purpose, the control program for driving the drum advances to a higher rotational speed for removing moisture and spin-drying the laundry in the laundry drum only when, in the course of a laundry distribution phase of this type, the unbalances have been compensated for or have been reduced at least to a level which is suitable for introducing higher rotational speeds.

In order to detect such an unbalance in the laundry drum, German patent DE 37 41 791 C3 and European patent EP 0 349 789 B1, corresponding to U.S. Pat. No. 5,098,224, disclose the use of a so-called tachogenerator as a rotary encoder. This is connected to the motor shaft and produces a signal voltage which corresponds to the respective rotational speed of the laundry drum and whose frequency is proportional to the rotational speed. The signal provided by the tachogenerator thus virtually represents the actual rotational speed of the laundry drum, the speed fluctuating as a function of the unbalance of the laundry in the laundry drum. A tachogenerator of this type as a rotary encoder thus detects those components of a vibratory movement of an internal unit, which is suspended such that it can vibrate, of a washing machine which lead to a corresponding angular acceleration or torque fluctuation about this axis of rotation.

SUMMARY OF THE INVENTION

It is accordingly an object of the invention to provide an internal unit, suspended such that it can vibrate, of a laundry treatment machine, method for controlling a laundry treatment machine, and use of an electronic sensor as a vibration sensor in an internal unit that overcome the above-mentioned disadvantages of the prior art device and methods, which detects a vibratory movement of an internal unit.

With the foregoing and other objects in view there is provided, in accordance with the invention, an internal unit for a laundry treatment machine, the internal unit being suspended such that it can vibrate in the laundry treatment machine. The internal unit contains a laundry drum, a drive, being an electric motor, for driving the laundry drum, and at least one vibration sensor being entirely rigidly or substantially rigidly coupled to a component of the internal unit.

According to the invention, the internal unit is suspended such that it can vibrate and contains a laundry drum and a drive which is in the form of an electric motor. The internal unit is preferably employed in a washing machine, in a spin-dryer, in a dryer or in a laundry-cleaning machine. The drive axis of rotation, about which the laundry drum rotates during operation, is disposed such that it is horizontal, upright or slanting, in particular at an angle of 45°, with respect to a flat base. Power is expediently transmitted from the electric motor to the rotary shaft of the laundry drum via a direct drive or an interposed transmission gear with transmission belts, or the like. According to the invention, at least one vibration sensor is provided which in its entirety is rigidly or substantially rigidly coupled to the internal unit. In other words, the vibration sensor or parts of it is or are not driven when the laundry drum is rotated by a drive. The configuration according to the invention therefore affords the advantage that a sensor system for detecting vibratory movements is formed which is particularly resistant to mechanical faults.

In one preferred embodiment, the vibration sensor is in the form of an electronic sensor, in particular in the form of an acceleration sensor. In this case, the measurement principle of the sensor is based on capacitive, inductive or piezoelectric effects in particular. This embodiment of the vibration sensor results in that all of the mechanical components—provided that they are actually present—are disposed inside a sensor housing such that they are isolated from the surroundings, and the vibration sensor is highly insensitive to mechanical and/or chemical influences from the outside. Suitable vibration sensors are sold by Star Micronics (New Jersey, USA) under the names ACA302 (3-axis capacitive sensor) or APA 304 (3-axis piezoceramic sensor), for example.

In one expedient development of the invention, the internal unit contains a printed circuit board on which the sensor is disposed as a printed circuit board component. This development is based on the consideration of using low-cost sensors which can be mounted on printed circuit boards. A printed circuit board of this type is rigidly or substantially rigidly coupled to the vibratory system, "the internal unit". The printed circuit. board is preferably coupled to a washing tub which is a constituent part of the internal unit, or, alternatively, the printed circuit board is fixed on and/or to the electric motor, for example.

The printed circuit board preferably fulfills a dual function and at the same time is in the form of a motor control-system printed circuit board which preferably has, inter alia, one or more electrical power output stages and/or a controller for the motor electronics, preferably in the form of a microcontroller or DSP or CPU, for controlling the electric motor, in particular for controlling its rotational speed. This embodiment affords the particular advantage that the signal paths between the vibration sensor and the controller are very short and therefore not sensitive to faults, and are implemented as conductor tracks, for example. A further advantage results from combining the engine control system and the vibration sensor on a common printed circuit board in that the measured values from the vibration sensor and at the same time feed and measured variables from the electric motor are supplied to the controller in a simple manner and the basis for controlling the movement of the electric motor in an optimum manner is provided in this way.

In one preferred embodiment of the invention, the vibration sensor is implemented and/or disposed in such a way that rotary vibratory movements of the internal unit about a first axis of rotation can be detected. The position of the first axis of rotation is preferably disposed obliquely to the laundry-drum drive axis of rotation, in particular so that an angle which differs from 0° is produced between the first axis of rotation and the drive axis of rotation. As an alternative, the first axis of rotation and the drive axis of rotation may also be disposed such that they are inclined with respect to one another, that is to say obliquely to one another, with imaginary extensions of the axes not intersecting. These refinements make it possible for the vibration sensor to detect rotary vibratory movements which contain a component which is independent of the rotary vibratory movement about the drive axis of rotation.

In one particularly preferred embodiment, the first axis of rotation is disposed perpendicular or substantially perpendicular to the drive axis of rotation, so that one component of the rotary vibratory movement which is independent of the rotary vibratory movement about the drive axis of rotation is measured. In this case, the rotary vibratory movements about axes which are perpendicular to the bearing axis or axis of rotation of the drum—also called pitching and yawing movements—and are regarded as being particularly critical are detected and therefore identified. It is therefore possible, with a washing machine having a horizontal laundry drum for example, for the yawing movements to cause the tub and thus the internal unit of the washing machine to strike the side walls of the the washing machine at high amplitudes, while pitching movements may cause the parts to strike the front face of the washing machine. Accordingly, if at least one of these vibratory movements is separately or additionally detected about an axis of rotation orthogonal to the drive axis of rotation, unbalances may be determined comparatively precisely and, in response to the detected unbalances, changes in the rotational speed may be comparatively exactly controlled to ensure safe and effective operation of the laundry treatment machine.

In one development of the invention, a further vibration sensor, in particular a tachogenerator, as is known from the prior art, for measuring the rotary vibratory movement about the laundry-drum drive axis of rotation is additionally provided.

In this case, the invention is based on the consideration that the vibratory movement of the internal unit of a laundry treatment machine can be detected particularly reliably when, in addition to a vibratory movement about the axis of rotation, which movement is reflected in the directly detectable change in rotational speed, a vibratory movement about at least one further axis is also detected, this axis not coinciding with the drive axis of rotation which is defined by the bearing shaft of the motor or of the laundry drum. Therefore, when there is an unbalanced load of laundry, the laundry drum rotates in a known manner not only about this axis of rotation which is defined by its bearing axis, but there are also vibratory movements, which are dependent on the position and the magnitude of the unbalanced load, on the or about the axes which are orthogonal to the axis of rotation and represent the y and z-axes with respect to a Cartesian coordinate system where the axis of rotation is on the x-axis.

In a more extensive or alternative embodiment, the vibration sensor is implemented and disposed in such a way that rotary vibratory movements about a second or about a second and a third axis of rotation can be detected. Provision is particularly made for the rotary movements about two or three axes of rotation to be detected by a single vibration sensor component. As an alternative or in addition, the vibration sensor is configured to detect linear vibratory movements in up to three independent directions in space.

In one preferred embodiment of the invention, provision is made for the sensor or sensors and/or vibration sensor or sensors to be connected to the controller. In particular, the programs and circuitry of the internal unit are formed in such a way that the measured values from the sensors and/or vibration sensors are taken into account in terms of open-loop control and closed-loop control when controlling the electric motor.

The object on which the invention is based is also achieved by a method for controlling a laundry treatment machine.

In the method, provision is made for the vibratory movements of an internal unit of the laundry treatment machine to be measured by one or more sensors. The internal unit contains at least one laundry drum and a drive for the laundry drum, which drive is in the form of an electric motor. At least one of the measuring sensors is in the form of an electronic sensor which in its entirety is rigidly or substantially rigidly coupled to the internal unit. As already explained above, the sensor is not carried along when the laundry drum is rotated by a drive, but only when the internal unit vibrates. The measured values of the vibratory movement are transmitted to a controller which is in the form of a microcontroller or the like. The controller evaluates the measured values from the sensor or sensors in real time and controls, likewise in real time, the electric motor as a function of the evaluated measured values. The method according to the invention provides substantially the same advantages as the inventive apparatus.

In one preferred embodiment of the method, provision is made to also supply the controller with an actual rotational speed value, in the form of an actual and/or setpoint value, in addition to the measured value of the rotary vibratory movement of the internal unit, and to calculate a reference variable for the vibratory deflection of the unit on the basis of these values. The following calculation formula, for example, is used in vibratory systems—assuming a harmonic vibration profile:

$$S_{max} \propto a_{max,w}/(2\pi f)^2$$

where:

$S_{max}$: is the maximum deflection of the vibration sensor on the motor and thus of the internal unit;

f: is the rotation frequency of the drum; and $a_{max,w}$: is the maximum acceleration value of the vibration sensor at the rotation frequency f of the drum.

In one expedient development of the method, provision is made to take into account motor feed variables, motor current, voltage, position signals or the like during. the evaluation of the measured values. Particular provision is made to use an internal unit as described above in the method.

The problem on which the invention is based is finally solved by the use of an electronic sensor as a vibration sensor in an internal unit.

In one development of the invention, the rotary vibratory movement about the laundry-drum drive axis of rotation is measured from the feed variables for the motor or the rotational-speed fluctuations in the motor.

Other features which are considered as characteristic for the invention are set forth in the appended claims.

Although the invention is illustrated and described herein as embodied in an internal unit, suspended such that it can vibrate, of a laundry treatment machine, method for controlling a laundry treatment machine, and use of an electronic sensor as a vibration sensor in an internal unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The single FIGURE of the drawing is a schematic rear view of a washing machine according to the invention.

DESCRIPTION OF THE PREFERRED EMBODIMENT

Referring now to the single FIGURE of the drawing in detail there is shown schematically a washing machine in a view from the end towards a rear face of a machine housing 1 of the washing machine, with the rear face shown being opposite a non-illustrated loading opening of the washing machine. An internal unit 2 is suspended in the machine housing 1 such that it can vibrate.

The internal unit 2 contains a washing tub 3, a washing or laundry drum 4, a drum belt pulley 5, a transmission belt 6, a motor belt pulley 7 and an electric motor 8. In other words, the internal unit 2 contains all of the constituent parts which together with the rotating washing or laundry drum 4 form a common vibratory system whose vibrations are isolated from and/or damped with respect to the machine housing 1 by the vibratory system being suspended.

The longitudinal extent of the drum-like washing tub 3 is oriented parallel to the base of the machine housing 1, that is to say is disposed horizontally in the machine housing 1. A first side wall of the washing tub 3 faces the loading opening. A right-angled coordinate system 9 with three axes is drawn above the schematic illustration of the washing machine, with the axis marked X being oriented parallel to the longitudinal extent of the washing tub 3.

The washing or laundry drum 4 is disposed concentrically within the washing tub 3 on a bearing shaft 17 and is particularly mounted in the rear wall of the washing tub 3—that is to say in the second side wall of the washing tub 3 which faces away from the loading opening—such that it can rotate.

The washing or laundry drum 4 is connected to the drum Belt pulley 5 such that they rotate together, the drum belt pulley 5 being disposed concentrically with respect to the washing or laundry drum 4, but its diameter being smaller than that of the washing or laundry drum 4. The drum belt pulley 5 is disposed on the side of the second side wall outside the washing tub 3. The drum belt pulley 5 is coupled to the motor belt pulley 7 by the transmission belt 6, the motor belt pulley 7 being oriented parallel to the drum belt pulley 5 but such that it is offset in the direction of the base of the machine housing 1. The motor belt pulley 7 is connected to an output or bearing shaft 18 of the electric motor 8 such that they rotate together, with the result that the motor belt pulley 7 is driven by the electric motor 8. The washing or laundry drum 4 is made to rotate within the washing tub 3 by the belt mechanism containing the motor belt pulley 7, the transmission belt 6 and the drum belt pulley 5. In one alternative embodiment, the washing or laundry drum 4 is moved by direct drive, the direct drive taking the place of the drum belt pulley 5.

Motor electronics 10, for example in the form of a flat or three-dimensional printed circuit board, are provided on the electric motor 8 and are rigidly connected to the electric motor 8. The motor electronics 10 contain the power output stage 15 for supplying power to the electric motor 8, a vibration sensor 13 for detecting vibrations of the internal unit 2, and a controller 14 for detecting the measured values from the vibration sensor 13 and for controlling the electric motor 8. The vibration sensor 13 is formed in such a way that it can measure rotations about the axes of the coordinate system 9 which are designated Y and/or Z and/or the angular accelerations which are associated with these rotations, that is to say in particular pitching movements of the internal unit 2 (about the Y-axis) and/or yawing movements of the internal unit 2 (about the Z-axis). In addition, the vibration sensor 13 may be formed in such a way that vibrations about the X-axis can be registered too.

The internal unit 2 is suspended in the upper region of the machine housing 1 by springs 11 which with one end each engage in the upper corner regions of the machine housing 1 and with the other end are fixed to the internal unit 2, in this case to the upper side of the washing tub 3, at four different positions. The internal unit 2 is also supported in the base region of the machine housing 1 by four friction dampers 12, which with one end are in each case supported in the corner regions of the machine housing 1. The other respective end is fixed to that side of the internal unit 2 which faces the base of the machine housing 1, in this case to the lower side of the washing tub 3, at four different positions.

In a variant of the invention, a further vibration sensor 16, in particular a tachogenerator, for measuring the rotary vibratory movement about the laundry-drum drive axis of rotation is additionally provided.

This application claims the priority, under 35 U.S.C. § 119, of German patent application No. 10 2005 007 413.8, filed Feb. 18, 2005 and German patent application No. 10 2005 037 144.2, filed Aug. 6, 2005; the entire disclosure of the prior applications are herewith incorporated by reference.

We claim:

1. An internal unit for a laundry treatment machine, the internal unit being suspended such that it can vibrate in the laundry treatment machine, the internal unit comprising:

a laundry drum;

a drive, being an electric motor, for driving said laundry drum;

at least one vibration sensor being rigidly coupled to said electric motor;

a printed circuit board being a motor control-system printed circuit board and said vibration sensor being a printed circuit board component on said printed circuit board; and said vibration sensor including a sensing element enclosed in a sensor housing, the sensor housing being configured to isolate the sensing element from mechanical noise originating outside of said sensor housing, whereby the sensing element detects a physical displacement of the vibration sensor on the motor resulting from a movement of the internal unit.

2. The internal unit according to claim 1, wherein said vibration sensor is an electronic sensor.

3. The internal unit according to claim 2, wherein said vibration sensor is based on a measurement principle using capacitive effects and/or inductive effects and/or piezoelectric effects.

4. The internal unit according to claim 1, wherein said vibration sensor is arranged to detect rotary vibratory movements of the internal unit about an axis of rotation.

5. The internal unit according to claim 4, wherein:

said electric motor and said laundry drum each have a bearing shaft; and said axis of rotation is disposed obliquely to a drive axis of rotation which is defined by said bearing shaft of said electric motor and/or of said laundry drum.

6. The internal unit according to claim 1, further comprising a further sensor for measuring a rotary vibratory movement of the internal unit about a first axis of rotation.

7. The internal unit according to claim 6, wherein said vibration sensor is arranged to detect rotary vibratory movements of the internal unit about a second axis of rotation and/or a third axis of rotation, with axes of rotation being disposed obliquely with respect to one another, including perpendicularly or substantially perpendicularly with respect to one another.

8. The internal unit according to claim 1, wherein said vibration sensor is formed and/or is disposed such that linear vibratory movements of the internal unit along a first and/or a second and/or a third direction in space can be detected.

9. The internal unit according to claim 1, further comprising a controller and said vibratory sensor is connected to said controller to transfer measured values from said vibratory sensor to said controller.

10. The internal unit according to claim 1, wherein said vibration sensor is an acceleration sensor.

11. The internal unit according to claim 1, further comprising a washing tub, said vibration sensor is rigidly coupled to said washing tub either directly or indirectly via said printed circuit board.

12. The internal unit according to claim 1, wherein said vibration sensor is rigidly coupled to said electric motor either directly or indirectly via said printed circuit board.

13. The internal unit according to claim 1, wherein said motor control-system printed circuit board has a power output stage and/or a controller for controlling said electric motor including for controlling a rotational speed.

14. The internal unit according to claim 4, wherein:

said electric motor and said laundry drum each have a bearing shaft; and said axis of rotation is disposed obliquely, namely perpendicular or substantially perpendicular, to a drive axis of rotation which is defined by said bearing shaft of said electric motor and/or of said laundry drum.

15. The internal unit according to claim 6, wherein said further sensor is a tachogenerator.

16. The internal unit according to claim 6, further comprising a controller and said vibratory sensor and said further sensor are connected to said controller for transferring measured values from said vibratory sensor and said further sensor to said controller.

17. A method for controlling a laundry treatment machine having at least one sensor measuring vibratory movements of an internal unit of the laundry treatment machine according to claim 1, which comprises the steps of:

transmitting measured values of the vibratory movements to a controller;

evaluating, in the controller, the measured values from the sensor in real time; and controlling the electric motor in dependence on an evaluation of the measured values.

18. The method according to claim 17, which further comprises:

evaluating, in the controller, an actual rotational speed of the laundry drum by the controller calculating a vibratory deflection of the internal unit, or a value which is proportional to the vibratory deflection, from the actual rotational speed and the measured values of the vibratory movement of the internal unit.

19. The method according to claim 17, which further comprises:

detecting, via the controller, motor feed variables; and controlling the electric motor on a basis of a joint evaluation of the motor feed variables and the measured values from the sensor.

20. The method according to claim 17, which further comprises suspending the internal unit such that the internal unit can vibrate in the laundry treatment machine.

21. A method of using an electronic sensor in an internal unit for a laundry treatment machine, the internal unit being suspended such that it can vibrate in the laundry treatment machine, the internal unit having a laundry drum and an electric motor for driving the laundry drum, which comprises the steps of:

providing a printed circuit board being a motor control-system printed circuit board;

coupling the electronic sensor, being a vibratory sensor, rigidly to the internal unit, the vibratory sensor being a printed circuit board component on the printed circuit board, and said vibratory sensor including a sensing element enclosed in a sensor housing, the sensor housing being configured to isolate the sensing element from mechanical noise originating outside of the sensor housing, whereby the sensing element detects a physical displacement of the vibratory sensor on the motor resulting from a movement of the internal unit;

transmitting measured values of vibratory movements to a controller;

evaluating, in the controller, the measured values from the sensor in real time; and controlling the electric motor in dependence on an evaluation of the measured values.

* * * * *